US009792753B2

(12) United States Patent
George et al.

(10) Patent No.: US 9,792,753 B2
(45) Date of Patent: Oct. 17, 2017

(54) SYSTEMS AND METHODS FOR PROCESSING BANK NOTES USING A DISTRIBUTED TRACKING SYSTEM

(71) Applicant: Toshiba International Corporation, Houston, TX (US)

(72) Inventors: Arin George, Dallas, TX (US); Sohail Kayani, Irving, TX (US)

(73) Assignee: Toshiba International Corporation, Houston, TX (US)

( * ) Notice: Subject to any disclaimer, the term of this patent is extended or adjusted under 35 U.S.C. 154(b) by 58 days.

(21) Appl. No.: 14/052,811

(22) Filed: Oct. 14, 2013

(65) Prior Publication Data

US 2015/0101906 A1 Apr. 16, 2015

(51) Int. Cl.
*G07F 7/04* (2006.01)
*G07D 11/00* (2006.01)

(52) U.S. Cl.
CPC ..... *G07D 11/0084* (2013.01); *G07D 11/006* (2013.01); *G07D 11/0036* (2013.01); *G07D 11/0051* (2013.01); *G07D 11/0054* (2013.01); *G07D 11/0066* (2013.01)

(58) Field of Classification Search
CPC ..... G07D 11/0051; G07D 11/0066; G07D 11/0069; G07D 11/0075; G07D 11/0078; G07D 11/0081; G07D 11/0072; G07D 11/0036; G07D 11/0039; G07D 11/0048; G07D 11/0084
USPC ..... 194/206, 207; 209/534; 382/182, 135, 382/136; 235/379
See application file for complete search history.

(56) References Cited

U.S. PATENT DOCUMENTS 6,045,039 A * 4/2000 Stinson et al. ..... 235/379
8,027,920 B1 * 9/2011 Allan ..... G06Q 20/10 705/35
8,162,125 B1 * 4/2012 Csulits et al. ..... 194/206
2003/0202690 A1 * 10/2003 Jones et al. ..... 382/139
2004/0238619 A1 * 12/2004 Nagasaka ..... G06K 9/2018 235/379
2005/0056519 A1 * 3/2005 Yokoi ..... G07D 11/0051 194/206
2006/0043167 A1 * 3/2006 Fujioka ..... G07D 11/0066 235/379
2008/0285838 A1 * 11/2008 Jones et al. ..... 382/135
2009/0048803 A1 * 2/2009 Zwieg ..... G07D 7/16 702/172
2009/0101705 A1 * 4/2009 Jenkins ..... G06Q 40/00 235/379

(Continued)

*Primary Examiner* — Jeffrey Shapiro
(74) *Attorney, Agent, or Firm* — Baker Botts L.L.P.

(57) ABSTRACT

A distributed system for tracking bank notes as they pass through an automated currency processing system is disclosed. The bank note processing system includes a conveyance device for transporting a bank note along a transport path and a detector module comprising a detector. The detector detects raw detector information from the bank note. The detector controller is communicatively coupled to the detector module and the raw detector information is communicated to the detector controller. A host controller is communicatively coupled to the detector controller. The detector controller processes the raw detector information to determine processed detector information. The detector controller then communicates the processed detector information to the host controller.

14 Claims, 3 Drawing Sheets

(56) References Cited

U.S. PATENT DOCUMENTS

| | | | | |
|---|---|---|---|---|
| 2009/0319080 | A1* | 12/2009 | Utsumi | G07D 11/0051 700/231 |
| 2012/0011813 | A1* | 1/2012 | Nakai | B65B 27/08 53/447 |
| 2012/0125734 | A1* | 5/2012 | Okamura | G07D 11/006 194/216 |
| 2014/0069769 | A1* | 3/2014 | Kobayashi | G07D 11/0084 194/206 |

* cited by examiner

SYSTEMS AND METHODS FOR PROCESSING BANK NOTES USING A DISTRIBUTED TRACKING SYSTEM

BACKGROUND OF THE INVENTION

1. Field of the Invention

The present invention relates to automated currency processing and, more specifically, to a distributed system for tracking bank notes as they pass through an automated currency processing system.

2. Description of Related Art Including Information Disclosed Under 37 CFR 1.97 and 1.98

Automated currency processors are common in the fields of bulk currency processing and are typically used by central banks, large commercial banks, print works, cash in transit, or other entities that require processing of large amounts of currency.

In operation, bank notes that require processing are fed into the automated currency processing machine by a feeder. The term "bank note" as used herein may generally include bills of different currencies, checks, or other instruments that are typically processed by a banking entity. The bank notes then travel down a high speed conveyor past a number of detector modules which detect various characteristics of the note. For instance, the detector modules may determine denomination, authenticity, bank note condition, or other desired characteristics of a bank note. Based on the characteristics detected, the bank note may then be routed to a number of different pockets for collation or destruction. These pockets may enable the automated currency processing machine to sort notes by fitness level, denomination, origin, authentication, or other desired characteristics.

However, with the increasing complexity of automated currency processing machines, it may be desirable to utilize an increasing number of modules. As the number of modules in the automated currency processing machine increases, it is desirable to develop a central controller that can efficiently track the passage of bank notes through the currency processing machine. It is desirable to develop an automated currency processing machine with a central processor that can handle a large number of modules in real-time and which can facilitate addition (or removal) of additional modules.

BRIEF DESCRIPTION OF THE SEVERAL VIEWS OF THE DRAWING(S)

The present invention will be more fully understood by reference to the following detailed description of the preferred embodiments of the present invention when read in conjunction with the accompanying drawings, in which like reference numbers refer to like parts throughout the views, wherein.

Figure 1:
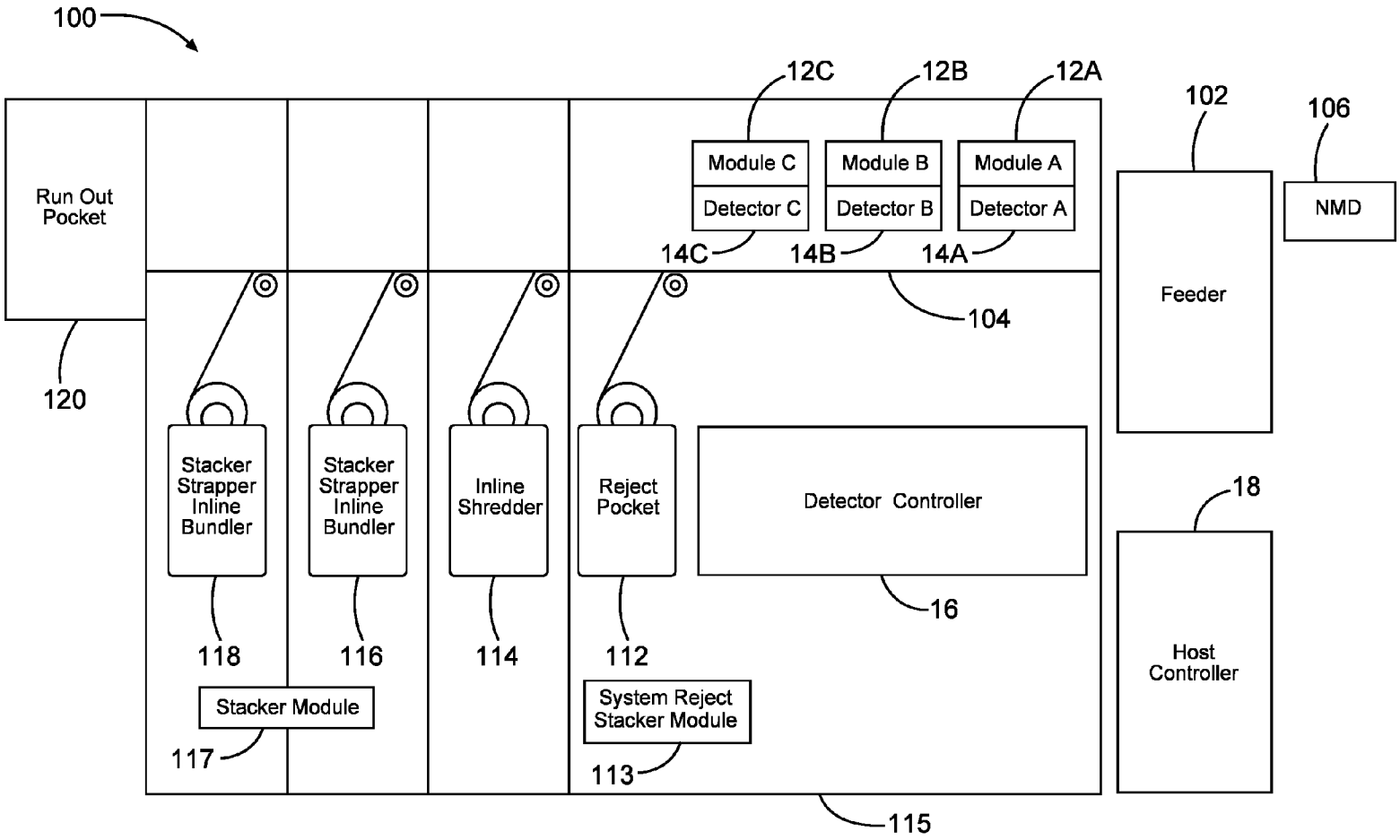
FIG. 1 depicts a block diagram of a Bank Note Tracking System ("BNTS") in accordance with an illustrative embodiment of the present disclosure.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

DETAILED DESCRIPTION OF THE INVENTION

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), flash memory; and/or any combination of the foregoing.

The terms "couple" or "couples," as used herein are intended to mean either an indirect or a direct connection. Thus, if a first device couples to a second device, that connection may be through a direct connection, or through an indirect mechanical or electrical connection via other devices and connections. Similarly, if a first device is communicatively coupled to a second device, the two devices may be able to communicate with one another directly or indirectly over any suitable wired or wireless communication network.

A block diagram of a Bank Note Tracking System ("BNTS") 100 in accordance with an illustrative embodiment of the present disclosure is shown in FIG. 1. The BNTS 100 is a real-time tracking system that may include one or more controllers, modules and/or detectors. Each of the controllers, modules and/or detectors of the BNTS 100 has specific responsibilities related to the tracking of a bank note. Specifically, the various components work in concert in order to efficiently track a bank note being processed in real time. In the illustrative embodiment of FIG. 1, the BNTS 100 includes three modules 12A, 12B, 12C. Each of the modules 12A, 12B, 12C may be responsible for tracking a bank note within its domain along a transport path 104, directing the necessary hardware to send the bank notes to the correct location, and/or calling jam conditions. Although three modules are shown in the illustrative embodiment of FIG. 1, the present disclosure is not limited to any specific number of modules. Accordingly, fewer or more modules may be used in the BNTS 100 without departing from the scope of the present disclosure.

Each of the modules 12A, 12B, 12C may include a corresponding detector 14A, 14B, 14C that is communicatively coupled to a detector controller 16. The detector controller 16 may be an information handling system. Although a single detector controller 16 is shown in the illustrative embodiment of FIG. 1, in certain embodiments, a separate detector controller may be used for each one or combination of detectors 14A-C without departing from the scope of the present disclosure. The detector controller 16 may gather raw detector information from the corresponding detectors 14A-C, associate the raw detector information gathered with the proper bank note passing through the system, process the raw detector information and send the processed detector information to a host controller 18 for decision making. This process is described in further detail below.

In certain implementations, one or more of the detectors 14A, 14B, 14C may include an imaging system and a raw detector. The imaging system of a detector may process the information it collects and send this processed data to the detector controller corresponding to the particular detector. In contrast, the raw detector simply collects data and forwards it to the detector controller 16.

The BNTS 100 may further include a host controller 18. The host controller 18 may be any suitable information handling system. The primary functions of the host controller 18 may include, but are not limited to, distribution of information relating to the bank note to the modules 12A, 12B, 12C; making sort decisions for the bank notes being processed; and/or keeping track of bank note counts.

The bank notes to be processed are fed into the BNTS 100 from a feeder 102. The bank notes are then directed along the transport path 104 from the feeder 102 through a scanner module 115 of the BNTS 100. The scanner module 115 may include one or more modules 12A, 12B, 12C each having a corresponding detector 14A, 14B, 14C.

Figure 2:
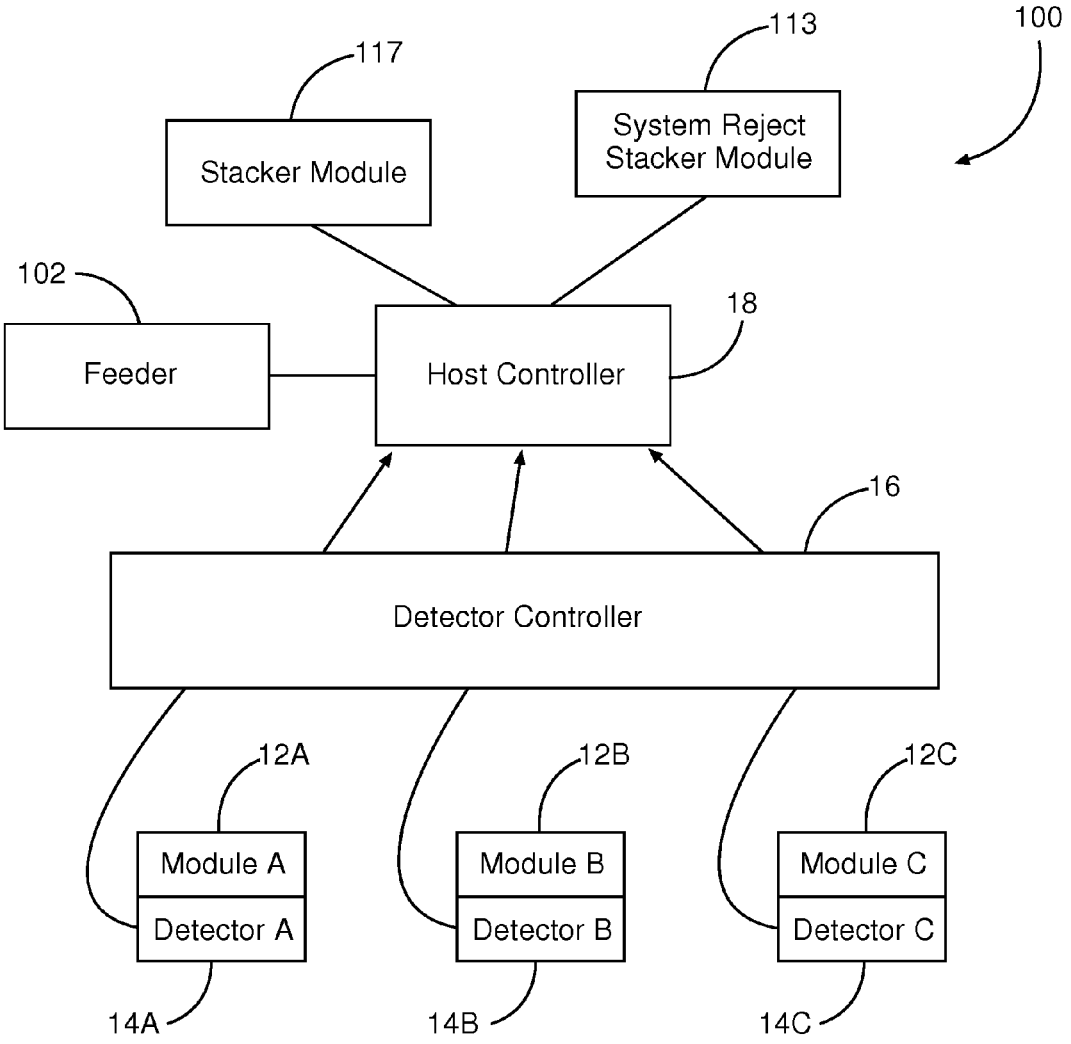
FIG. 2 depicts a system configuration showing communication paths in a BNTS in accordance with an illustrative embodiment of the present disclosure.

Turning now to FIG. 2, a system configuration showing the communication path between some of the components of the BNTS 100 is depicted. As shown in FIG. 2, one or more components of the BNTS 100 are communicatively coupled to each other. Wired or wireless communication means may be used to achieve any desired communications between the different components. For instance, the host controller 18 may be communicatively coupled to the detector controller 16. Similarly, the host controller 18 may be communicatively coupled to the detectors 14A-C and modules 12A-C through the detector controller 16. Additionally, the host controller 18 may be communicatively coupled to the feeder 102, a system reject stacker module 113 and a stacker module 117 which are discussed in further detail below. FIG. 2 is provided for illustrative purposes only and the present disclosure is not limited to any specific number of modules. Accordingly, additional modules may be incorporated into the BNTS 100 and may be communicatively coupled to the host controller 18 without departing from the scope of the present disclosure.

In certain illustrative embodiments, the communications between two or more components of the BNTS 100 may occur using the TCP/IP protocol over the Ethernet, or serial communications using RS422 or RS485. In certain embodiments, communications from the modules 12A-C, 113, 117, and the raw detectors of the detectors 14A-C to the hardware components may be handled over a parallel port using the Extensible Provisioning Protocol ("EPP"). Further, in certain embodiments, one or more of the modules 12A-C may include a camera that may be used to capture images that are processed and used to evaluate one or more characteristics of a bank note. In some illustrative embodiments, the imaging system of the detectors 14A-C may communicate with a physical camera using the GigE Vision protocol. The structure and operation of such communication protocols is well known to those of ordinary skill in the art, having the benefit of the present disclosure and will therefore, not be discussed in detail herein.

Returning to FIG. 1, one or more of the detectors 14A-C may include both an imaging system and a raw detector. Although three modules and detectors are shown in FIG. 2, the present disclosure is not limited to any specific number of modules or detectors. Accordingly, fewer or more modules or detectors may be utilized without departing from the scope of the present disclosure.

The one or more modules 12A-C may be any suitable detector module known to those of ordinary skill in the art, having the benefit of the present disclosure. For instance, in certain implementations, the one or more modules 12A-C may be used to detect the denomination of a bank note, whether the bank note is counterfeit, and/or perforations or other damage to the bank notes.

As shown in FIG. 2, the feeder 102 may be communicatively coupled to the host controller 18. In accordance with an illustrative embodiment of the present disclosure, as a bank note is directed into the BNTS 100 through the feeder 102, the feeder 102 communicates information about the bank note to the host controller 18. The bank note information relayed from the feeder 102 to the host controller 18 may include, but is not limited to, information relating to bank note tracking, bank note creation time, bank note position, bank note condition (e.g., wear and tear), ability of the machine to process the bank note for timing purposes, etc. The host controller 18 is in turn communicatively coupled to the modules 12A-C, 113, 117. Accordingly, the host controller 18 may forward the bank note information it received from the feeder 102 to one or more of the modules 12A-C, 113, 117. The modules that receive the bank note information from the host controller 18 may then start tracking the bank note in the BNTS 100.

Additionally, as discussed above, the host controller 18 may be communicatively coupled to the detector controller 16. Accordingly, the host controller 18 may also relay the bank note information received from the feeder 102 to the detector controller 16. The detector controller 16 is communicatively coupled to the detectors 14A-C and forwards the bank note information received from the host controller 18 to imaging systems associated with the detectors 14A-C. The imaging systems receive the bank note information from the detector controller 16, process that information, and send the processed bank note information back to the detector controller 16. In certain illustrative embodiments, the processed bank note information may include, but is not limited to, denomination of the bank note, orientation of the bank note, condition/fitness of the bank note, etc.

As a bank note travels along the transport path 104, it passes by the detectors 14A-C. The raw detector of the detectors 14A-C gathers raw detector information from the bank note and communicates that raw detector information back to the detector controller 16. The detector controller 16 process the raw detector information received from the raw detectors and any processed information received from the imaging systems and produces a processed detector information associated with a corresponding detector module 12A-C. Depending on the particular module, the processed detector information may be any desired bank note characteristic including, but not limited to, information relating to bank note denomination, whether the bank note is counterfeit, and/or presence of perforations or other damage to the bank notes. The detector controller 16 then communicates this processed detector information back to the host controller 18.

The host controller 18 may include or may be coupled to a computer-readable medium which may contain sort rules for the bank notes. The term "sort rules" as used herein refers to a set of rules that specify the destination for a bank note depending on the information obtained from the detector modules 12A-C and their associated detectors 14A-C. For instance, in one illustrative embodiment, the sort rules may specify that if a module indicates that a bank note has a particular denomination, then it must be directed to a particular output pocket. Similarly, in certain implementations, the sort rules may specify that if a bank note is damaged beyond a pre-set threshold value, it must be sent to a reject pocket or be shredded. The present disclosure is not limited to any specific set of sort rules. Accordingly, the host controller 18 may be guided by any number or type of sort rules without departing from the scope of the present disclosure.

Once the host controller 18 receives the processed detector information from the detector controller 16, it runs the sort rules on the processed detector information and determines a destination for the bank note. In the illustrative embodiment of FIG. 1, the destinations or pockets available for the BNTS 100 include a reject pocket 112, an inline shredder 114, a first stacker strapper inline bundler 116 and a second stacker strapper inline bundler 118. Additionally, the system includes a run out pocket 120. As would be appreciated by those of ordinary skill in the art, having the benefit of the present disclosure, the present disclosure is not limited to any specific number, type or configuration of pockets. Accordingly, any number or type of output pockets may be used without departing from the scope of the present disclosure.

Each pocket of the BNTS 100 may include a pre pocket Item Presence Detector ("IPD") and/or an in pocket IPD. The pre pocket IPD detects the presence of a bank note which is waiting to be permitted into the pocket at the pocket entrance. Accordingly, once the pre pocket IPD for a pocket has been set, a decision must be made on whether to open the gate of the pocket to permit the bank note to enter the pocket or keep the gate closed so that the bank note will pass by the pocket. Similarly, once the in pocket IPD for a pocket has been set, it indicates that a bank note has entered the pocket.

Once the host controller 18 determines the destination for a particular bank note passing along the transport path 104, it notifies the modules 12A-C, 113, 117 of the bank note's destination. The modules 12A-C, 113, 117 then track the bank note to its final destination as determined by the host controller 118. In certain illustrative embodiments, once the bank note reaches its final destination, the modules 12A-C, 113, 117 send a message to the host controller 18 notifying it that the bank note has been delivered. The host controller 18 validates this information by using the tracking identification of the bank note that was generated at the start of the process by the feeder 102. Once the information is validated, the host controller 18 communicates a message to the modules 12A-C confirming that the bank note has been delivered and instructing them to retire that particular bank note from the list of outstanding bank notes.

Figure 3:
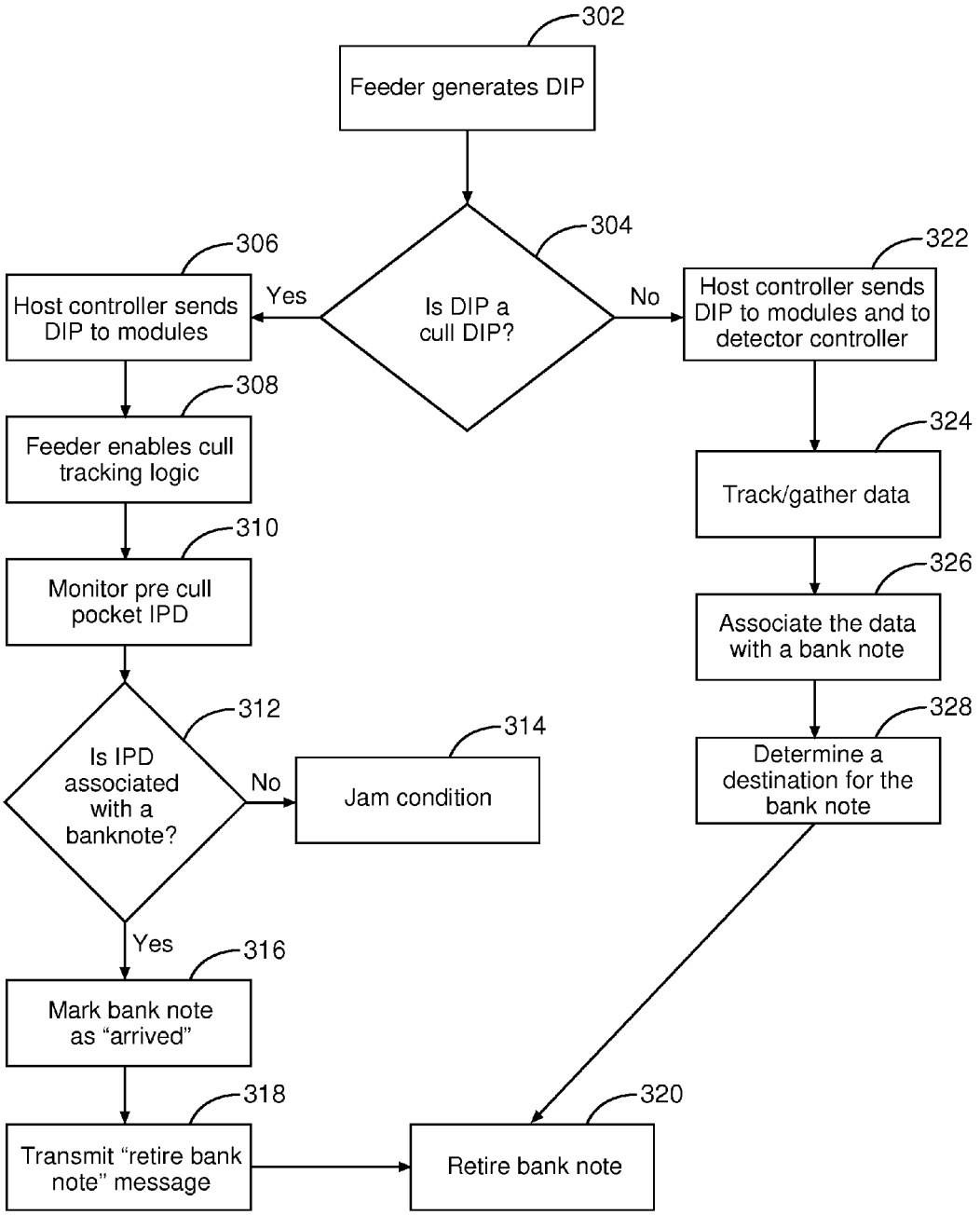
FIG. 3 depicts method steps for processing bank notes in accordance with an illustrative embodiment of the present disclosure.

The processing of bank notes by the BNTS 100 is discussed in further detail in conjunction with FIG. 3 which depicts method steps for processing bank notes in accordance with an illustrative embodiment of the present disclosure.

First, at step 302, the bank note to be processed is directed into the BNTS 100 through the feeder 102 which generates a Document Identification Packet ("DIP") corresponding to the bank note. Specifically, the feeder 102 is communicatively coupled to a non-machinable detector (NMD) 106. The NMD 106 is a detector which monitors the bank notes passing through the feeder 102. Once a valid edge of a bank note is detected by the NMD 106, the NMD 106 notifies the feeder 102. The term "valid edge" as used herein refers to the start of the banknote The feeder 102 then tracks the lead edge of the bank note and waits for a notification from the NMD 106 that the trail edge has been reached. Accordingly, once the NMD 106 determines that a trail edge of a bank note has been reached, it notifies the feeder 102. Specifically, once the sensor in the NMD 106 no longer detects the bank note, it concludes that the trail edge of the bank note has been reached. Once the feeder 102 has been notified about the lead edge and the trail edge of a bank note, it waits for a message from the NMD 106 about the bank note itself. Specifically, the message from NMD 106 may contain information including, but not limited to, information relating to decisions about whether the bank note is a cull bank note or not, such as for example, information relating to skew, feed timing, length, and close feed. Communications between NMD 106 and the feeder 102 exchange these decisions. If any of these decisions are set, then the bank note is designated as a cull bank note. The term "cull bank note" as used herein refers to a bank note that is selected based on certain pre-set criteria. In contrast, a "non-cull bank note" is a bank note that is not selected because it does not meet the pre-set criteria. The pre-set criteria that may be used to identify a bank note as a cull bank note or a non-cull bank note may be stored in a computer-readable medium that is accessible by the NMD 106.

Once the feeder 102 receives the final decision from the NMD 106, it generates a DIP for the particular bank note. The DIP may be a cull DIP or a normal DIP. In accordance with certain implementations, both the cull DIP and the normal DIP may share similar information such as, for example, a bank note identifier that is assigned by the feeder module 102, the lead edge time for the bank note identifier, the trail edge time for the bank note identifier, the length of the bank note identifier, and/or the transport speed at the time of document creation. The term "document creation" as used herein refers to the process whereby the NMD 106 has sufficient information to declare that a valid document has entered the machine. In addition, the cull DIP may include the cull reasons. In contrast, the normal DIP does not include the cull reasons. The DIP may then be used to track the bank note as it passes through the BNTS 100 to ensure that it is directed to the correct output pocket.

Once the DIP for a bank note is generated by the feeder 102 at step 302, it is communicated from the feeder 102 to the host controller 18 which is communicatively coupled to the feeder 102. Once the host controller 18 received the DIP, it determines whether the packet is a cull DIP or a normal DIP at step 304. Specifically, if the packet is a cull DIP, it indicates that the bank note is a cull bank note. In contrast, if the packet is a normal DIP it indicates that the bank note is a non-cull bank note. As discussed in further detail below, the host controller 18 determines a process for handling the bank note depending on whether the bank note is a cull bank note or a non-cull bank note. Once the bank note has been processed, it is "retired".

If the packet received is a cull DIP indicating that the bank note is a cull bank note, at step 306, the host controller 18 will only send the information in the DIP to the modules 12A-C, 113, 117. Once the DIP is received by the modules 12A-C, 113, 117, each module will process the cull DIP. Additionally, once the feeder 102 determines that a bank note is a cull bank note, at step 308 it enables cull tracking logic which is a specific logic for tracking culled bank notes to the cull pocket. The cull tracking logic then begins to track the bank note. Additionally, the feeder 102 enables the negative arrival tracking for the post cull pocket. The post cull pocket is a pocket that may be used to collect bank notes that are not machine processable, are mutilated, are doubles, are skewed, etc.

Next, at step 310 the feeder 102 monitors the pre cull pocket IPD to determine if a bank note is waiting to enter the cull pocket. The pre cull pocket IPD indicates the presence of a bank note waiting to enter the cull pocket. At step 312 the feeder's 102 cull document tracker checks to determine if the pre cull pocket IPD can be associated with a bank note. If the cull document tracker determines that the pre cull pocket IPD cannot be associated with a bank note, at step 314 the feeder 102 identifies a jam condition. Additionally, the feeder 102 will identify a jam condition if a bank note's lead edge is not detected at the pre cull pocket IPD within a reasonable amount of time. The processing of jam conditions is well known to those of ordinary skill in the art, having the benefit of the present disclosure, and will therefore not be discussed in detail herein. If the cull document tracker of the feeder 102 determines that the pre cull pocket IPD is associated with a bank note, at step 316 the feeder marks the bank note as having arrived at the cull pocket and directs the hardware to open the gate of the feeder 102 in order for the bank note to enter the system.

Next, the feeder 102 looks for the trail edge of the bank note at the pre cull pocket IPD. If the feeder 102 does not identify a trail edge of the bank note within a reasonable time, it identifies a jam condition. In contrast, if the feeder 102 identifies a trail edge of the bank note being processed it notes that information and continues to process the bank note, expecting the bank note to arrive at the cull pocket IPD. Once the bank note arrives at the cull pocket IPD and is validated as a bank note, the feeder 102 transmits a "retire bank note" message to the host controller 18 at step 318. In certain illustrative embodiments, the bank note is validated using the timing of arrival and the lead/trail edge being at the right place time wise. The host controller 18 then acknowledges the receipt of the "retire bank note" message and transmits the "retire bank note" message to the modules 12A-C, 113, 117 of the BNTS 100. Once the modules 12A-C, 113, 117 receive the "retire bank note" message from the host controller 18, they retire that particular bank note at step 320 and remove it from their active list. The term "active list" as used herein refers to a list maintained by the modules 12A-C, 113, 117 in a computer readable medium which includes the bank notes that are being processed through the BNTS 100 and have not yet reached their destination. Additionally, once the host controller 18 forwards the "retire bank note" message to the modules 12A-C, 113, 117, it counts the cull incident (i.e., the number of bank notes directed to cull pocket) in the cull pocket and records its characteristics. The recorded characteristics references herein include, but are not limited to, characteristics that indicate that a bank note is mutilated, double, skewed, long, short, etc.

As bank notes are being processed by the BNTS 100, a number of special situations may arise. For instance, the bank note may arrive at the in pocket IPD before it leaves the pre pocket IPD due to length considerations. Specifically, the lead edge may be at a point where it is not logical for it to be as the trail edge has not left the previous position. Additionally, the bank note may not enter the pocket it is directed to but may pass the gate of the feeder 102. In this case, the negative arrival tracking system will identify the occurrence of this condition and the feeder 102 will call a jam condition. Finally, a bank note may merge with a previous bank note. This condition may occur if the bank note did not arrive at the post cull pocket and the negative arrival tracking did not call a jam condition.

In contrast, if at step 304 it is determined that the DIP is a normal document packet and not a cull document packet, indicating a non-cull bank note, the host controller 18 forwards the normal document packet to the modules 12A-C, 113, 117 as well as the detector controller 16 at step 322. Once the modules 12A-C, 113, 117 receive this information, they start tracking the bank note in the normal note tracking system. Accordingly, all of the modules 12A-C may predict when that particular bank note should arrive and leave the IPDs. In certain illustrative embodiments, this prediction is made using the timing information generated at document creation.

Once the feeder 102 detects the arrival of the bank note being processed at the pre cull pocket IPD, it instructs the hardware to close the gate of the pocket in question so that the bank note can go through. The feeder 102 also checks to make sure that the bank note left the pre cull pocket IPD in time. In contrast, the post cull pocket IPD checks to make sure that the bank note arrived at post cull pocket and left it in a timely manner. At this point, the bank note is still active in the feeder module since it has not yet been retired.

Further, once the detector controller 16 detects the arrival of a bank note, it starts a processing window of time for the detectors 14A-C. Specifically, one of the main functions of the detector controller 16 is to generate a window of time for the detectors 14A-C to gather data specific to a particular bank note. The detector controller 16 may generate this window of time by generating an electrical signal. When generating the window of time, the detector controller 16 may look at the timing of the bank note as the factor. The windows generated by the detector controller 16 may be adjusted for bank note slippage as the bank note is seen at each of the IPDs that it passes through before it reaches each detector 14A-C. Finally, once the bank note has passed by all the detectors 14A-C, the detector controller 16 may notify the host controller 18 to identify a destination for the bank note.

At step 324, the bank note is tracked through the system and the detectors 14A-C are used to gather data from the bank note. Specifically, once the detector controller 16 receives the bank note information from the host controller 18, it starts tracking when raw detector information for that bank note should come from the detectors 14A-C. Similarly, the window of time generated for a particular bank note may be communicated from the detector controller 16 to the raw detectors. The raw detectors of the detectors 14A-C gather raw data from the bank note during the designated window of time. This raw data is then packaged and directed to the detector controller 16 for processing. In certain implementations, information from two or more raw detectors may have to be consolidated by the detector controller 16. In such instances when there is dependent detector information from other detectors that has to be received (e.g., an edge and center detector of the same type), the processing of raw data by the detector controller 16 may be delayed until all dependent information is received. Eventually, the detector controller 16 processes all the raw data gathered. This processed detector information may then be relayed to the host controller 18.

Additionally, the detector controller 16 forwards the bank note information to the imaging system of the detectors 14A-C. In certain implementations, the imaging systems may include one or more cameras that are used to image a bank note as it passes along the transport path 104. Accordingly, once the imaging system of a detector 14A-C receives the bank note information it may queue up grab buffers for each of its one or more cameras. The detectors 14A-C then activate the camera(s) of the imaging system for the specific window of time identified by the detector controller 16. Accordingly, the camera(s) of an imaging system of a detector 14A-C will capture data from the bank note for the window of time designated by the detector controller 16 and send that data to the imaging system. The imaging system of the detector 14A-C processes the data obtained from the cameras and communicates the processed data to the detector controller 16. Like the processed detector information, the processed data from the imaging system is directed to the host controller 18 from the detector controller 16.

The processed detector information and the processed data from the imaging system of the detectors 14A-C is received by the host controller 18 before the host controller 18 needs to make a detector decision. The term "detector decision" as used herein refers to what the detectors believe the bank note is (e.g., denomination, condition of the bank note, etc.). Accordingly, the detectors 14A-C must communicate the data (including any raw detector information as well as any data from the imaging system) to the detector controller 16 in a timely manner so that the data can be processed and relayed to the host controller 18 in time.

Next, at step 326, the host controller 18 associates the processed data it received from the detector controller 16 with the particular bank note that is going through the system. The host controller 18 may then determine a destination for the bank note at step 328. In certain implementations, the detector controller 16 may generate a sort decision request to the host controller 18. In response, the host controller 18 runs through its sort rules and applies the sort rules to the processed data associated with the particular bank note which was received from the detector controller 16. Following the application of the sort rules to the processed data, the host controller 18 determines a destination for the particular bank note. The determined destination for the bank note is then communicated to the modules 12A-C, 113, 117. Once the bank note's destination is known, the modules 12A-C, 113, 117 modify their tracking operation to track the bank note into a specific pocket (112, 114, 116, 118) designated by the host controller 18. Moreover, in certain implementations, based on the destination determination made by the host controller 18, one or more of the modules 12A-C, 113, 117 may simply track the bank note as it passes by.

Finally, the process proceeds to step 320 where the bank note is retired. Specifically, as the bank note leaves the modules 12A-C along the transport path 104, it reaches the first output pocket which is typically the reject pocket 112. At this point, the system reject stacker module 113 checks to determine if the bank note has a designated valid destination. Specifically, the system reject stacker module 113 may communicate with the host controller 18 to identify the designated destination for the bank note being processed. If the bank note does not have a valid destination, then the system reject pocket module 113 redirects the bank note from the transport path 104 into the reject pocket 112 (or the inline shredder 114 if so desired) and the bank note is retired (i.e., removed from the list of "active" bank notes). If the bank note does have a valid designated destination, it continues along the transport path 104 and past the reject pocket 112 (and/or the inline shredder 114).

Each of the stacker strapper inline bundlers 116, 118 may be equipped with one or more IPDs which operate in a manner similar to the cull tracking IPDs. In certain implementations, a stacker module 117 may regulate the operation of the stacker strapper inline bundlers 116, 118. Specifically, as a bank note approaches the stacker strapper inline bundlers 116, 118, the host controller 18 may communicate the designated destination for that particular bank note to the stacker module 117. For instance, if a bank note has a valid destination which is designated as the stacker strapper inline bundler 116, then once the bank note is detected by the pre-pocket IPD, the gate of the stacker module 117 opens the gate of the stacker strapper inline bundler 116 to permit the bank note to enter the stacker strapper inline bundler 116. The bank note is then retired.

In contrast, if the designated destination of the bank note is a pocket past the stacker strapper inline bundler 116 (e.g., stacker strapper inline bundler 118), then stacker module 117 closes the gate of the stacker strapper inline bundler 116 when the bank note arrives at the pre-pocket IPD. In the same manner, this process continues until the bank note reaches it's designated destination as determined by the host controller 18. Once the back note is delivered to its final designated destination, it is retired.

In certain implementations, if the stacker module 117 determines that the bank note should not enter a particular output pocket (e.g., 116, 118) because it was supposed to enter an earlier pocket, stacker module 117 closes the gate for the particular output pocket permitting the bank note to go past that pocket. The stacker module 117 may then generate a jam condition.

After a bank note is detected at the in pocket IPD of one of the output pockets (e.g., stacker strapper inline bundlers 116, 118), then the stacker module 117 may communicate a message to the host controller 118 asking the host controller to retire that particular bank note. Once the host controller 18 receives the request to retire the bank note, it validates that request and sends confirmation that the bank note should be retired to all the modules of the BNTS 100. All the modules (e.g., modules 12A-C, system reject stacker module 113, stacker module 117) will then retire that particular bank note from their active list. The host controller 18 then takes the information gathered for the particular bank note and may add that information to its data repository of processed notes. For instance, in certain implementation, the information gathered may include the denomination of the note and once the note is retired, that denomination may be added to the count of the total bank notes processed. At this point, the bank note is no longer active in the system.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

I claim:

1. A bank note processing system comprising:

a conveyance device for transporting a bank note along a transport path;

a plurality of detector modules each comprising a detector, wherein each detector detects raw detector information from the bank note;

a detector controller communicatively coupled to the detector modules, wherein the raw detector information from each of the detectors is communicated to the detector controller; and a host controller communicatively coupled to the detector controller, wherein the detector controller processes the raw detector information to determine processed detector information, wherein the detector controller communicates the processed detector information to the host controller, wherein the host controller determines the destination of the bank note by applying predetermined sort rules on the processed detector information communicated from the detector controller;

wherein the host controller notifies the detector modules of the bank note's destination after determining the destination for a particular bank note passing along the transport path; and wherein the detector modules track the bank note to its final destination as determined by the host controller and sends a message to the host controller notifying the host controller that the bank note has been delivered once the bank note reaches its final destination.

2. The system of claim 1, wherein the detector controller associates the raw detector information with the bank note.

3. The system of claim 1, wherein the detector modules comprise an imaging system and a raw detector.

4. The system of claim 1, wherein the host controller keeps track of the bank note and distributed information received from the detector controller to the plurality of detector modules.

5. The system of claim 1, further comprising a feeder, a stacker module, and a system reject stacker module communicatively coupled to the host controller.

6. The system of claim 5, wherein the feeder communicates bank note information to the host controller, wherein the bank note information is selected from a group consisting of bank note tracking, bank note creation time, bank note position, bank note condition, and ability of the system to process the bank note.

7. The system of claim 6, wherein the host controller communicates the bank note information to at least one of the detector module and the detector controller.

8. The system of claim 7, wherein the detector module further comprises an imaging system and wherein the imaging system receives the bank note information, processes the bank note information and communicates the processed bank note information to the detector controller.

9. The system of claim 8, wherein the processed bank note information is selected from a group consisting of a denomination of the bank note, orientation of the bank note and condition of the bank note.

10. The system of claim 1, wherein the host controller is coupled to a computer-readable medium containing sort rules and wherein the host controller determines destination of the bank note using the sort rules and the processed detector information.

11. The system of claim 1, wherein the destination of the bank note is selected from a group consisting of a reject pocket, an inline shredder, a first stacker strapper inline bundler and a second stacker strapper inline bundler.

12. A method of processing a bank note comprising:

directing the bank note along a transport path through a feeder;

obtaining raw detector information from the bank note using a detector module;

communicating the raw detector information from the detector modules to a detector controller;

processing the raw detector information in the detector controller to obtain processed detector information;

communicating the processed detector information from the detector controller to a host controller; and controlling the transfer of the bank note along the transport path to a pocket using the host controller, wherein the host controller controls the transfer of the bank note by applying predetermined sort rules on the processed detector information communicated from the detector controller to the host controller;

wherein the host controller notifies the detector modules of the bank note's destination after determining the destination for a particular bank note passing along the transport path; and wherein the detector modules track the bank note to its final destination as determined by the host controller and sends a message to the host controller notifying the host controller that the bank note has been delivered once the bank note reaches its final destination.

13. The method of claim 12, further comprising associating the raw detector information with the bank note, wherein the detector controller associates the raw detector information with the bank note.

14. The method of claim 12, further comprising collecting bank note information at the feeder and communicating the bank note information from the feeder to the host controller.

* * * * *